United States Patent [19]

Kosch

[11] Patent Number: 4,508,291

[45] Date of Patent: Apr. 2, 1985

[54] WELDING WIRE DISPENSER

[76] Inventor: Delmar D. Kosch, 1730 Woodland Dr., Columbus, Nebr. 68601

[21] Appl. No.: 655,230

[22] Filed: Sep. 27, 1984

[51] Int. Cl.[3] ..... B65H 59/04

[52] U.S. Cl. ..... 242/156.2; 242/54 R; 242/99; 242/129.8

[58] Field of Search ..... 242/156.2, 156, 129.8, 242/75.4, 75.43, 99, 54 R

[56] References Cited

U.S. PATENT DOCUMENTS

| | | | |
|---|---|---|---|
| 438,782 | 10/1890 | Stowbridge | 242/156.2 X |
| 653,717 | 7/1900 | Wardwell, Jr. | 242/156.2 |
| 1,418,706 | 6/1922 | Hampton | 242/156.2 |
| 2,127,936 | 8/1938 | Pierce | 242/156.2 X |
| 2,528,410 | 10/1950 | Banaszak | 242/156.2 |
| 3,004,732 | 10/1961 | Fischer | 242/129.8 |
| 3,101,912 | 8/1963 | Bartlett | 242/156.2 |
| 3,323,752 | 6/1967 | Kurtz | 242/129.8 |
| 3,436,031 | 4/1969 | Winders | 242/156.2 |
| 4,003,290 | 1/1977 | Haehnel et al. | 87/57 |
| 4,241,884 | 12/1980 | Lynch | 254/54 R |
| 4,456,198 | 6/1984 | Kosch | 242/156.2 |
| 4,465,246 | 8/1984 | Kosch | 242/156.2 |

*Primary Examiner*—Stanley N. Gilreath
*Attorney, Agent, or Firm*—Zarley, McKee, Thomte, Voorhees & Sease

[57] ABSTRACT

A welding wire dispenser for dispensing wire to a wire feeder comprising a floor-engaging support which has an annular brake pad positioned on the upper end thereof. A ball screw assembly is mounted on the support and has a coil spring secured thereto which yieldably resists the rotation of the ball screw in one direction. A shaft is secured to the upper end of the ball screw assembly and is vertically movable therewith. A coil support is rotatably mounted on the shaft above the support and is vertically movable with the shaft. The coil support is adapted to support a coil or reel of welding wire thereon. The coil support has a horizontally disposed annular portion at its lower end which is adapted to frictionally engage the annular brake pad to limit the rotation of the coil support at times. An arm is secured to the upper end of the shaft and extends upwardly and outwardly therefrom. A pulley is supported on the outer end of the arm and has the wire extending from the wire coil received thereon. As the wire feeder pulls wire from the coil, the arm pivots towards the wire feeder which causes the shaft and the ball screw assembly to rotate and to raise the coil support upwardly so that the coil support will freely rotate. A spring is engagement with the ball screw assembly for rotatably urging the shaft in a direction so that the ball screw assembly will move the shaft downwardly relative to the support.

3 Claims, 5 Drawing Figures

WELDING WIRE DISPENSER

BACKGROUND OF THE INVENTION

In many types of welding operations, a wire feeder feeds wire to a welder. The welding wire is normally wound upon coils or reels and is unwound therefrom as wire is being consumed. Some types of wire dispensers have been provided which can dispense wire from wooden reels while other types of wire dispensers have been provided which can dispense wire from paper reels. However, the best of applicant's knowledge, a wire dispenser has not been provided which can accommodate both paper and wooden spools.

One type of wire dispenser is disclosed in U.S. Pat. No. 4,235,624 wherein wire is pulled from a stationary coil. However, a twist or torque is created in the wire and such a twist or torque frequently interferes with the welding operation. Many other types of wire dispensers have also been provided but they are either extremely cumbersome, expensive or difficult to use.

A welding wire dispenser was disclosed in applicant's U.S. Pat. No. 4,456,198 and represented a significant advance in the art. In the device of said patent, the weight of the wire reel causes the reel support to lower into braking engagement. It was found that it is sometimes necessary to move the braking surfaces into contact with one another by means of a spring when the wire on the reel is substantially depleted thereby resulting in less weight. Accordingly, a second patent was granted to applicant on an improvement in a welding wire dispenser and said improvement is disclosed in U.S. Pat. No. 4,465,246.

Although the welding wire dispensers disclosed in applicant's patents did represent a significant advance in the art, it has been found that an improved means for moving the braking surfaces out of frictional engagement with each other was advantageous. The welding wire dispenser of this application provides an improved means for raising and lowering the coil support and supporting shaft.

SUMMARY OF THE INVENTION

A welding wire dispenser is disclosed which dispenses wire to a wire feeder. A floor-engaging support means is provided and has an annular brake pad positioned on the upper end thereof. A ball screw assembly is provided on the support means and has a coil spring secured thereto to yieldably resist the rotation of the ball screw in one direction. A shaft is secured to the upper end of the ball screw assembly is vertically movable therewith. A coil support is rotatably mounted on the shaft above the support means and is vertically movable with the shaft. The coil support is adapted to support a coil or reel of welding wire thereon. An arm is removably secured to the upper end of the shaft and extends upwardly and outwardly therefrom so that a pulley at the outer end thereof is disposed laterally of the wire coil. The wire from the coil extends around the pulley and the movement of the wire towards the wire feeder causes the arm to move towards the wire feeder which causes the shaft to rotate which causes the ball screw assembly to rotate thereby causing the shaft to vertically move upwardly so that the coil support may freely rotate with respect to the brake pad. The spring which is connected to the ball screw yieldably resists the rotation of the ball screw assembly in such a manner so that the coil support will move into frictional engagement with the brake pad.

A principal object of the invention is to provide an extremely simple but yet efficient welding wire dispenser.

A further object of the invention is to provide a welding wire dispenser which relies upon the weight of the wire and a spring to aid in halting the rotation of the coil.

A still further object of the invention is to provide a welding wire dispenser which utilizes a ball screw assembly for supporting the coil support.

Yet another object of the invention is to provide a welding wire dispenser which is economical of manufacture and durable in use.

These and other objects will be apparent to those skilled in the art.

DESCRIPTION OF THE PREFERRED EMBODIMENT

Figure 1:
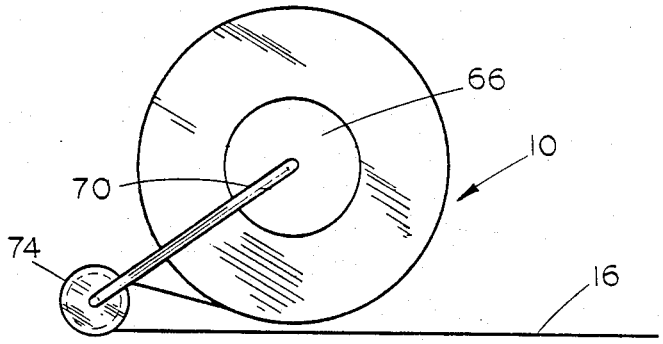
FIG. 1 is a top elevational view of the wire dispenser of this invention.

The wire dispenser of this invention is referred to generally by the reference numeral 10 while the reference numeral 12 refers to a conventional wire feeder adapted to supply welding wire 16 to welder 14 which includes tip 15.

Dispenser 10 includes a floor-engaging support means 18 which is provided with an annular brake pad 20 at its upper end. Support means 18 is also provided with an internally threaded opening 22 formed therein which is adapted to threadably receive the exterior housing portion 24 of a conventional ball screw assembly 26. Housing portion 24 is provided with a helical semi-circular groove 28 formed therein which receives the balls 30. As seen in the drawings, balls 30 are also received in a helical groove 32 formed in screw 34. The upper end of housing portion 24 is threadably received in the threaded opening 22 and has a central opening formed therein through which the screw 34 extends as seen in the drawings.

Spring 36 embraces the ball screw assembly 26 and has its upper end 38 connected to ear 40 which extends downwardly from support means 18. The lower end 42 of spring 36 is connected to spring adjustment plate 44 which is secured to the lower end of screw 34 by bolt or cap screws 46 and 48. As seen in the drawings, cap screws 46 and 48 extend upwardly through washer 50 and are threadably received by the lower end of screw 34. The washer 50 forces the member 44 into frictional engagement with the lower end of the screw 34 to maintain the member 44 in position. When it is desired to vary the torque of the spring 36, the cap screws 46 and 48 are loosened so that element 44 may be rotated relative to the screw 34. Rotation of element 44 with respect to screw 34 causes the torque of the spring 36 to either be increased or decreased.

The numeral 52 refers to a coil support which is rotatably mounted on the shaft 54 which extends upwardly from the screw 34. Coil support 52 is rotatably mounted on the shaft 54 by bearings 56 and 58. As seen in the drawings, coil support 52 is vertically movable with the shaft 54. As seen in the drawings, coil support 52 includes a plurality of radially extending arms 60 adapted to support the coil or reel 62 thereon. Upstanding members 64 are provided on the support 60 to aid in positioning the reel 62 on the support 52. The coil 62 is maintained on the support 52 by any convenient means such as by some sort of cover 66 clamped onto the upper surface of the reel or coil.

As seen in the drawings, shaft 54 includes a pair of laterally extending pins 68 adjacent the upper end thereof. The lower end of arm 70 embraces the upper end of shaft 54 and has a pair of cut-out portions or notches 72 formed therein adapted to receive the pins 68 so that the lower end of arm 70 will rotate with shaft 54 and vice versa. Arm 70 extends upwardly through the center of the reel and extends laterally outwardly therefrom. As seen in the drawings, the outer end of arm 70 is provided with a pulley 74 rotatably mounted thereon adapted to have the wire 16 extending therearound.

Figure 2:
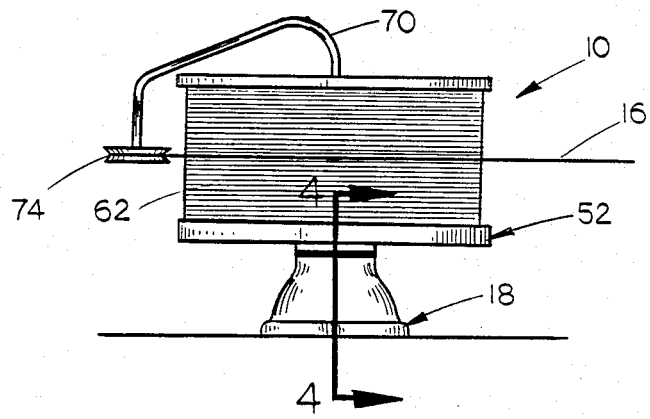
FIG. 2 is a side view of the dispenser of this invention.
Figure 3:
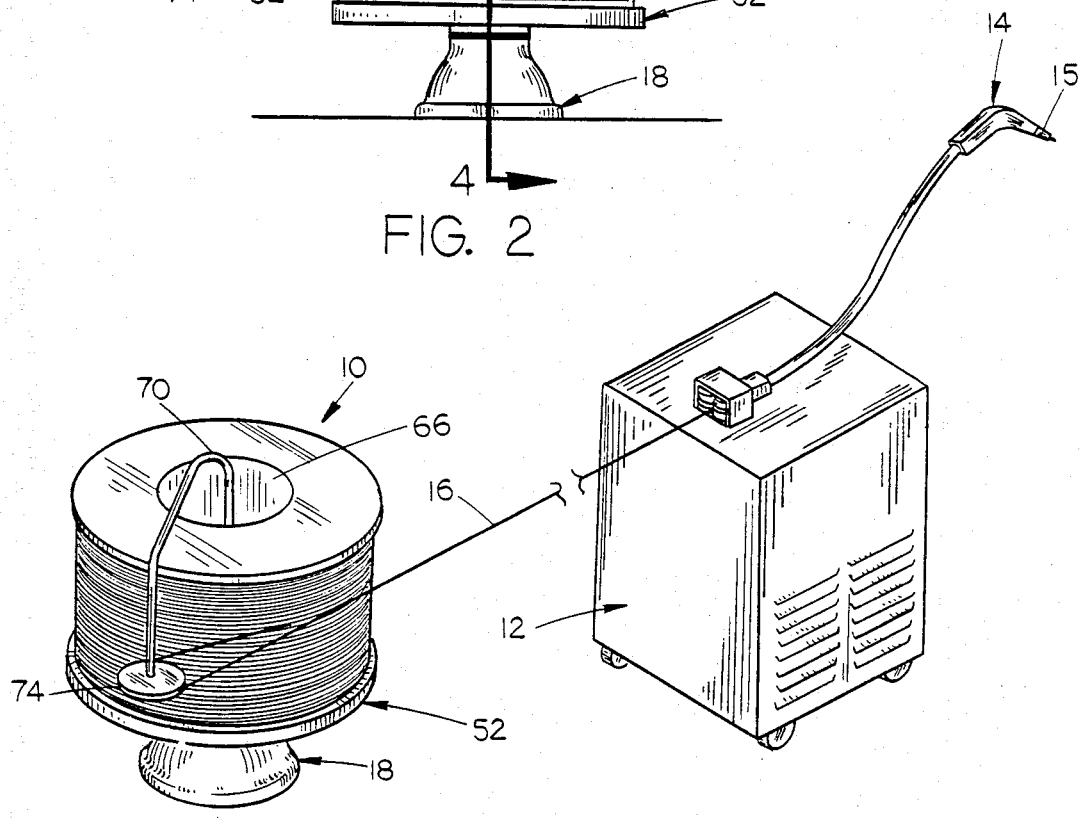
FIG. 3 is a perspective view of the wire dispenser of this invention illustrating its relationship with a wire feeder.
Figure 4:
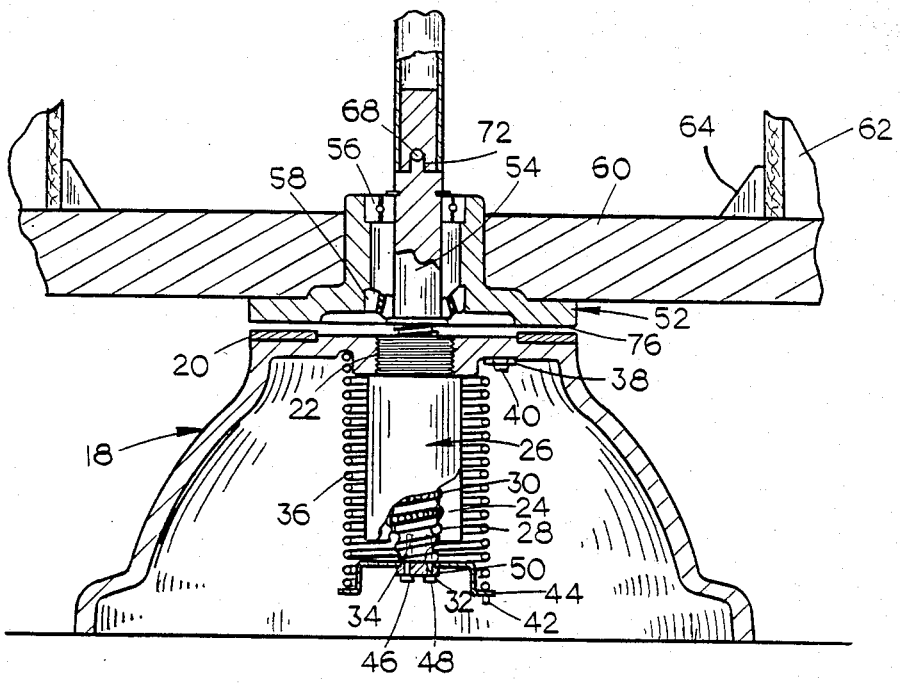
FIG. 4 is an enlarged sectional view seen on lines 4—4 of FIG. 2 illustrating the coil support out of braking engagement with the brake pad.
Figure 5:
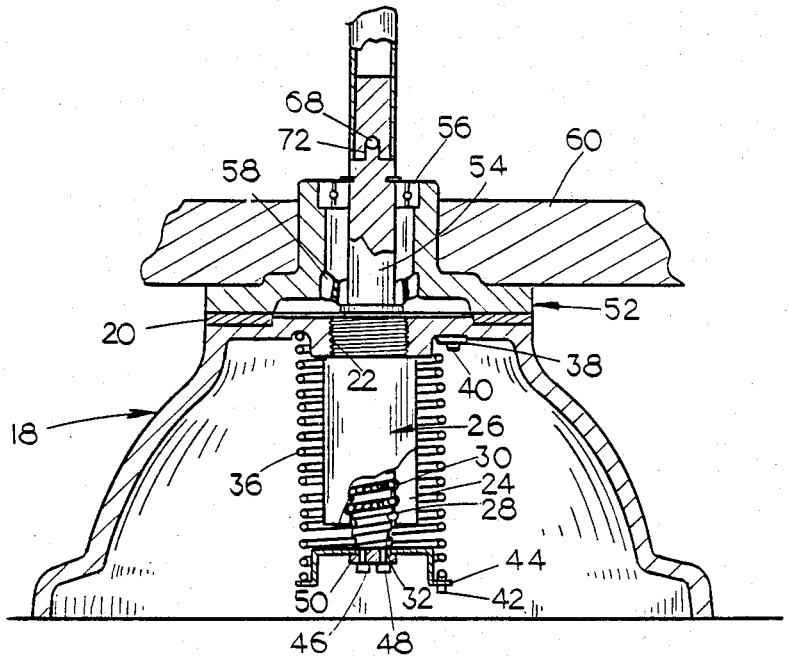
FIG. 5 is a view similar to FIG. 4 except that the coil support has been lowered into engagement with the brake pad.

In operation, the arm 70 would initially be removed from the shaft 54 and the cover 66 removed with the reel 52 being placed on the members 60. The cover 66 is then replaced. The straps maintaining the wire on the reel in position would be removed and the wire 16 extends around the pulley 74 as illustrated in FIGS. 1–3. The wire 16 is then fed through the wire feeder and extended through the tip 15 on the welder 14. The coil support 52 is normally in the position illustrated in FIG. 5 with the annular portion 76 of support 52 being in frictional engagement with the brake-lining material 20 which prevents rotation of the support means 52 relative to the support means 18. As the wire feeder 12 pulls wire from the coil, the arm 70 will be pivotally moved towards the wire feeder 12 which will cause shaft 54 to be rotated. The rotation of the shaft 54 causes screw 34 to rotate relative to the outer housing portion 24. Rotation of screw 34 relative to outer housing portion 24 causes the screw 34 to move upwardly due to the relationship of the helical grooves and balls. As the screw 34 moves upwardly relative to outer housing portion 24, spring 36 is twisted or turned into compression. Upwardly vertical movement of the shaft 54 causes the annular portion 76 of the support 52 to be moved out of frictional engagement with the brake-lining material 20 thereby permitting support 52 and the coil 62 to rotate so that wire can be dispensed therefrom. When the wire feeder 12 stops pulling wire, the weight of the coil 62 and the resiliency of the spring 36 causes the screw 34 to rotate relative to the outer housing portion 24 to return the arm 70 to the starting position. This particular feature allows the full weight of the wire coil to apply the brake to the rotation of the coil and to stop the rotation of the coil. The braking action is enhanced by the spring 36 as previously described. Thus, when the coil is substantially full, a large amount of force will be needed to brake the coil but the weight of the coil will apply that force. Conversely, when the remaining amount of wire on the coil is low, very little braking force will be needed to halt the rotation of the coil.

The wire dispenser of this invention dispenses welding wire to the wire feeder in a smooth fashion so that the welding operation will be smooth. It has been found that the ball screw assembly 26 utilized in this particular embodiment, provides even a smoother operating apparatus than that described in applicant's earlier patents.

Thus it can be seen that a wire dispenser of this invention accomplishes at least all of its stated objectives.

I claim:

1. A welding wire dispenser for dispensing wire to a wire feeder, a support means having a horizontally disposed annular portion at its upper end, a ball screw assembly comprising an outer housing portion rigidly secured to said support means, a vertically disposed, rotatable screw mounted in said outer housing portion and extending upwardly therefrom, a vertically disposed and vertically movable shaft secured to the upper end of said screw and extending upwardly therefrom, a coil support means rotatably mounted on the upper end of said shaft above said support means and vertically movable with said shaft, said coil support means having a horizontally disposed annular portion at its lower end adapted to frictionally engage said annular portion on said support means to limit the rotation of said coil support means when said annular portions are in frictional engagement with each other, said coil support means adapted to support a coil of welding wire thereon, an arm means removably secured to the upper end of said shaft and having an outer end portion disposed laterally of the coil of wire on the coil support means, and a pulley rotatably mounted about a vertical axis on the outer end portion of the arm means adapted to have the welding wire on the coil extending therearound, said screw moving upwardly relative to said outer housing portion and said support means thereby vertically moving said shaft so that said annular portions will not be in frictional engagement with each other so that said coil support means may freely rotate when said arm means is moved toward the wire feeder.

2. The dispenser of claim 1 wherein a spring means is in operative engagement with said screw which yieldably resists the rotation of said screws as said screw moves upwardly relative to said outer housing portion.

3. The dispenser of claim 2 wherein means is provided for adjusting the torque of said spring means.

* * * * *